US006248490B1

(12) United States Patent
Suzuki et al.

(10) Patent No.: US 6,248,490 B1
(45) Date of Patent: Jun. 19, 2001

(54) ELECTROPHOTOGRAPHIC PHOTOSENSITIVE MEMBER, PROCESS CARTRIDGE, AND ELECTROPHOTOGRAPHIC APPARATUS

(75) Inventors: Koichi Suzuki, Yokohama; Tomohiro Kimura, Kawasaki; Masato Tanaka; Hideaki Nagasaka, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/451,445

(22) Filed: Nov. 30, 1999

(30) Foreign Application Priority Data

Dec. 1, 1998 (JP) ..... 10-341649
Dec. 1, 1998 (JP) ..... 10-341650

(51) Int. Cl.[7] ..... G03G 5/087

(52) U.S. Cl. ..... 430/69; 430/73; 430/78; 399/297

(58) Field of Search ..... 430/63, 64, 69, 430/73, 78, 58.8; 399/297

(56) References Cited

U.S. PATENT DOCUMENTS

| | | | | |
|---|---|---|---|---|
| 4,357,403 | | 11/1982 | Shimada et al. | 430/18 |
| 4,710,441 | * | 12/1987 | Ritchie et al. | 430/69 |
| 4,780,385 | * | 10/1988 | Wieloch et al. | 430/69 |
| 5,358,813 | | 10/1994 | Iijima et al. | 430/59 |
| 5,393,629 | | 2/1995 | Nukada et al. | 430/76 |
| 5,607,802 | * | 3/1997 | Mishra et al. | 430/63 |
| 5,800,956 | | 9/1998 | Minemura et al. | 430/60 |

FOREIGN PATENT DOCUMENTS

| | | |
|---|---|---|
| 4412138 | 10/1995 | (DE) . |
| 0841595 | 5/1998 | (EP) . |
| 0919877 | 6/1999 | (EP) . |
| 12733 | 5/1979 | (JP) . |
| 029051 | 2/1982 | (JP) . |
| 062056 | 4/1982 | (JP) . |
| 014841 | 1/1983 | (JP) . |
| 239248 | 10/1986 | (JP) . |
| 67094 | 3/1987 | (JP) . |
| 017066 | 1/1989 | (JP) . |
| 029852 | 1/1989 | (JP) . |
| 221459 | 9/1989 | (JP) . |
| 007070 | 1/1990 | (JP) . |
| 054265 | 3/1991 | (JP) . |
| 128973 | 5/1991 | (JP) . |
| 098181 | 4/1993 | (JP) . |
| 194523 | 8/1993 | (JP) . |
| 247361 | 9/1993 | (JP) . |
| 263007 | 10/1993 | (JP) . |
| 279591 | 10/1993 | (JP) . |
| 073303 | 3/1994 | (JP) . |
| 093203 | 4/1994 | (JP) . |
| 279698 | 10/1994 | (JP) . |
| 053891 | 2/1995 | (JP) . |
| 053892 | 2/1995 | (JP) . |
| 207171 | 8/1995 | (JP) . |

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member is comprised of an aluminum substrate and a photosensitive layer provided thereon. The surface substrate on the side of the photosensitive member contains the elements aluminum, oxygen and titanium, or the elements aluminum, oxygen and zirconium. The photosensitive layer contains chlorogallium phthalocyanine, hydroxygallium phthalocyanine or oxytitanium phthalocyanine. The oxytitanium phthalocyanine has an intense peak at each of the Bragg's angles (2θG+0.2°) shown in any one of the specific five groups in CuKα-characteristic X-ray diffraction.

21 Claims, 13 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the invention

This invention relates to an electrophotographic photosensitive member, and a process cartridge and an electrophotographic apparatus which have the photosensitive member.

2. Related Background Art

Electrophotographic photosensitive members are constituted basically of a photosensitive layer on which a latent image is formed by electrostatic charging and exposure to light and a substrate on which the photosensitive layer is provided.

Meanwhile, electrophotographic photosensitive members are required to have sensitivities, electric properties and optical characteristics in accordance with electrophotographic processes applied.

They are also required to have an environmental stability in any environment of from low temperature/low humidity to high temperature/high humidity so as to sufficiently exhibit their performances.

Faulty images are exemplified typically by white lines, black spots in white background areas, white spots in black background areas, background fog in white background areas, and also interference fringes caused by factors such as surface shape of substrates and uneven layer thickness of photosensitive members in the case of apparatus such as digital copying machines and laser beam printers in which exposure is effected using a light source having a single wavelength. Accordingly, in the manufacture of photosensitive members, some countermeasures must be taken so that these faulty images do not occur.

As a factor having a great influence when such faulty images occur, the surface state of a substrate may be key.

Substrates having not been treated at all after molding, in general, do not necessarily have an optimum surface state for photosensitive members. Hence, problems caused by the surface state may occur in many instances.

To solve such problems, some approaches have hitherto been proposed, as exemplified by a method in which the surface of an aluminum substrate is subjected to chromate to form a chromate chemical conversion coating, as disclosed in Japanese Patent Application Laid-open No. 54-12733 and No. 57-62056; a method in which a boehmite coating is formed on the surface of an aluminum substrate, as disclosed in Japanese Patent Application Laid-open No. 58-14841 and No. 64-29852; and a method in which the surface of an aluminum substrate is oxidized forcedly by high-temperature treatment to form an oxide film, as disclosed in Japanese Patent Application Laid-open No. 57-29051.

With regard to, e.g., the method of chromate treatment, substrates having a good performance to a certain degree can be obtained. However, since treating solutions contain chromium, it is very difficult to dispose of waste liquor, and also this is not preferable in view of environmental safety.

With regard to the boehmite treatment, the crystal state of the surface can not be said to be suited for substrates of electrophotographic photosensitive members. It can be effective to a certain degree with regard to electrophotographic performance, but, with regard to images, no satisfactory image quality has been achieved because the surface structure and shape are unsatisfactory. Thus, under existing circumstances, those satisfying all performances have not been available.

The aim of the above surface treatment is to form on the substrate surface a coating which prevents any non-uniformity in electrophotographic performances and images from occurring due to electric charges injected locally from the substrate into the photosensitive layer.

As a method of preventing such local charge injection so as to prevent faulty images, a method is available in which the surface of an aluminum substrate is subjected to anodizing to provide a layer of aluminum oxide (e.g., Japanese Patent Application Laid-open No. 2-7070 and No. 5-34964).

This method is a good method in order to attain such an aim. However, in order to form the layer uniformly without causing any uneven layer thickness on the substrate surface, it must be formed thicker about 5 or 6 $\mu$m or more under the usual conditions for its formation. Hence, the layer must be formed in a much larger thickness than the thickness actually required as a charge injection blocking layer, resulting in an increase in cost.

Semiconductor lasers prevailingly used at present in laser beam printers and so forth have a relatively long oscillation wavelength as long as 790±20 nm. Accordingly, as charge-generating materials used in photosensitive layers, those having sufficient sensitivities to such a long-wavelength light are being studied.

In particular, much research has been conducted on phthalocyanine pigments because of their good sensitivities to long-wavelength light.

The phthalocyanine pigments may include, e.g., metal-free phthalocyanine, copper phthalocyanine, aluminum chlorophthalocyanine, oxyvanadyl phthalocyanine, oxytitanium phthalocyanine, chlorogallium phthalocyanine and hydroxygallium phthalocyanine. Most of these phthalocyanine compounds are known to have various crystal forms.

With regard to the chlorogallium phthalocyanine and hydroxygallium phthalocyanine having especially high sensitivities to long-wavelength light, they also have many crystal forms. As to the chlorogallium phthalocyanines, they are disclosed in Japanese Patent Application Laid-open No. 1-221459, No. 5-98181, No. 5-194523, No. 5-247361, No. 6-73303, No. 7-53891 and No. 7-207171. As to the hydroxygallium phthalocyanines, they are disclosed in Japanese Patent Application Laid-open No. 5-236007, No. 5-279591, No. 6-93203, No. 6-279698 and No. 7-53892.

With regard to the oxytitanium phthalocyanine, it also has many crystal forms. For example, oxytitanium phthalocyanines having different crystal forms are reported in Japanese Patent Application Laid-open No. 61-239248, No. 62-67094, No. 1-17066, No. 3-128973 and No. 3-54265.

However, compared with azo pigments, these phthalocyanine compounds tend to affect charge stability or image stability as a result of extended operation or depending on environment, and also tend to cause a problem of a rise in residual potential, ascribable to substrates or subbing layers. Accordingly, studies are made on electrophotographic photosensitive members that can satisfy these performances at a higher level.

SUMMARY OF THE INVENTION

An object of the present invention is to provide an electrophotographic photosensitive member having a superior charge stability after extended operation and environment and a superior image stability after extended operation and environment.

Another object of the present invention is to provide a process cartridge and an electrophotographic apparatus which have such an electrophotographic photosensitive member.

To achieve the above objects, the present invention provides an electrophotographic photosensitive member which comprises an aluminum substrate and a photosensitive layer provided thereon;

wherein the substrate contains the elements aluminum, oxygen and titanium or the elements aluminum, oxygen and zirconium, at its surface portion on the side of the photosensitive layer; and the photosensitive layer contains a chlorogallium phthalocyanine, a hydroxygallium phthalocyanine or an oxytitanium phthalocyanine having an intense peak at each of the Bragg's angles (2θ±0.2°) shown in any one of the following groups a) to e) in CuKα-characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.40°.

The present invention also provides a process cartridge and an electrophotographic apparatus which have the electrophotographic photosensitive member described above.

DESCRIPTION OF THE PREFERRED EMBODIMENTS

Figure 1:
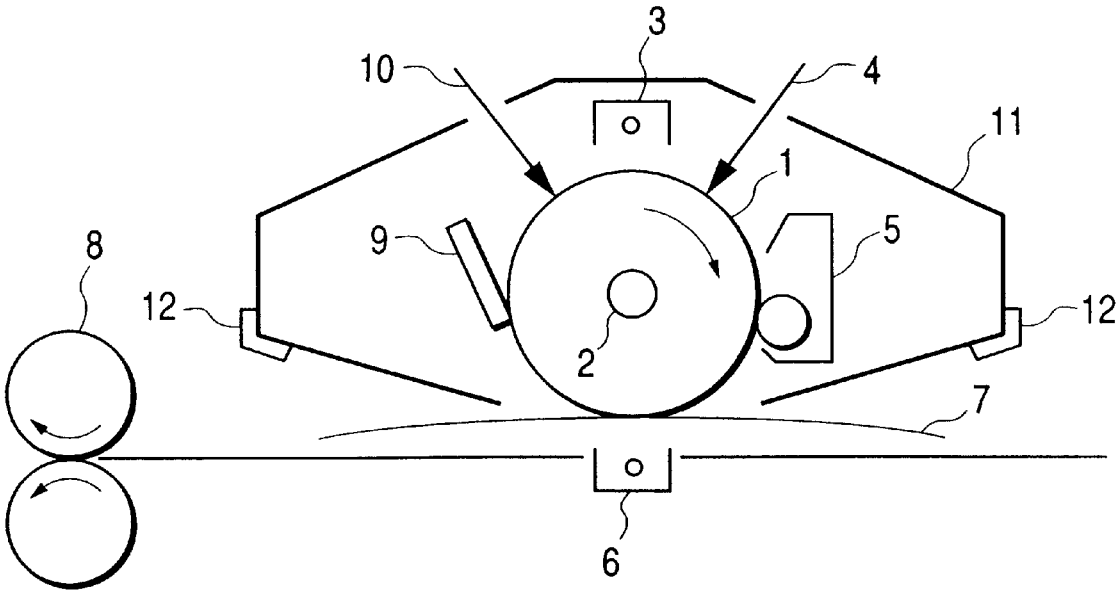
FIG. 1 schematically illustrates an example of the construction of an electrophotographic apparatus provided with a process cartridge having the electrophotographic photosensitive member of the present invention.

The electrophotographic photosensitive member of the present invention has a specific substrate and a specific photosensitive layer provided thereon.

More specifically, the substrate contains an aluminum element, an oxygen element and a titanium element, or an aluminum element, an oxygen element and a zirconium element, at its surface portion on the side of the photosensitive layer; and the photosensitive layer contains a chlorogallium phthalocyanine, a hydroxygallium phthalocyanine or an oxytitanium phthalocyanine, the oxytitanium phthalocyanine having an intense peak at each of the Bragg's angles (2θ±0.2°) shown in any one of the following groups a) to e) of in CuKα characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.4°.

The above substrate can be obtained by subjecting an aluminum substrate to specific chemical conversion, i.e., by chemical reaction of the substrate with an aqueous acid solution containing specific metallic elements, to form on the substrate an insoluble coating having a specific composition, without applying any electrical external force. This method is a very effective means in view of such advantages that electrophotographic photosensitive members having good performances can be obtained, the cost and adverse influence on environment may be made very small and the production equipment can be made simpler than that for anodizing.

The chemical conversion referred to in the present invention is a treatment where a substrate is brought into contact with a specific solution to form on the substrate a coating having specific composition, without applying any electrical external force as in anodizing.

Metals of the metal salts used in the present invention are titanium and zirconium.

The salt of titanium and salt of zirconium to be added may preferably be fluorine compounds. The salt of titanium may include titanium hydrofluoride, a sodium salt, potassium salt or ammonium salt thereof, and titanium sulfate. The salt of zirconium may include potassium zircon fluoride and zirconium sulfate.

The aqueous acid solution may contain the metal salt in a metal concentration of from 0.01 g to 2 g/liter.

The aqueous acid solution may also preferably contain fluorine ions in a concentration ranging from 0 g to 10 g/liter. Within this range, etching reaction may appropriately take place on the substrate surface and a uniform coating can be formed with ease.

The aqueous acid solution of the present invention may have a pH adjusted within the range of from 1.0 to 5.5 using ammonia or sodium hydroxide. If it has a pH below 1.0, the etching reaction may take place violently to make it difficult to obtain a good coating. If it has a pH above 5.5, the coating may be formed at so low a rate that only a thin coating can be obtained, making it difficult to obtain a remarkable effect of the present invention.

In the present invention, in view of such an advantage that the reaction takes place stably, the aqueous acid solution may preferably be heated to 30 to 90° C. when used.

As methods for bringing the substrate into contact with the aqueous acid solution, either method of dipping and spraying may be used. Dipping is preferred in view of production efficiency.

The substrate having been subjected to the chemical conversion is used after it is washed and dried.

The composition of the substrate surface portion in the present invention is measured by scanning Auger electron ray spectroscopy, and is defined to be the one within the range of from the uppermost surface to a depth of 50 Å ($5\times10^{-3}$ $\mu$m).

In the present invention, the titanium or zirconium may be contained in an amount ranging from 4 to 100 atom %.

The chemical conversion coating containing titanium or zirconium, formed on the substrate surface may preferably have a total layer thickness of 1 $\mu$m or smaller, and more preferably 50 Å ($5\times10^{-3}$ $\mu$m) or larger. If the coating is in a layer thickness larger than 1 $\mu$m, it is hard for electric charges to escape, tending to cause an increase in residual potential or fog. If it is in a layer thickness smaller than 50 Å ($5\times10^{-3}$ $\mu$m), a remarkable effect of the present invention may be obtained with difficulty.

In the present invention, in view of corrosion resistance and adhesion of coating films, the aqueous acid solution may preferably further contain a phosphoric acid, a phosphate, a tannin or a tannic acid.

The phosphoric acid and phosphate may include phosphoric acid and a sodium, potassium or ammonium salt of phosphoric acid; pyrophosphoric acid, tripolyphosphoric acid, hexametaphosphoric acid, and condensed phosphates of alkali metal salts such as a sodium salt or potassium salt of any of these acids. Besides the phosphoric acid, organic phosphoric acid compounds may also be used as exemplified by phytic acid, nitrodiethanolethylene phosphonic acid, 2-hydroxyethylmethacryl-1-acid phosphonic acid, 2-ethylhexyl acid phosphonic acid and ethane-1-hydroxy-1, 1-diphosphonic acid.

The phosphoric acid or phosphate in the aqueous acid solution may preferably be in a concentration ranging from 0.05 to 50 g/liter in terms of phosphate ions. Within this range, an especially uniform and good chemical conversion coating can be formed and also the treating solution can have an especially good stability.

The tannin or tannic acid may include quebracho tannin, depside tannin, Chinese tannic acid, Turkish tannic acid, hamamelitannic acid, chebulinic acid, sumac tannin, Chinese gallotannic acid and ellagic acid tannin.

The tannin or tannic acid in the aqueous acid solution may preferably be in a concentration ranging from 0.1 to 10 g/liter.

In the present invention, hydrofluoric acid, borofluoric acid, hydrosilicofluoric acid or a salt of any of these may preferably be added to the aqueous acid solution. These compounds have the function to etch the substrate surface when the substrate is subjected to chemical conversion, and hence a very uniform chemical conversion coating can be formed.

From the foregoing, it is preferable for the chemical conversion coating of the present invention to contain phosphorus and fluorine.

There are no particular limitations on the aluminum substrate so long as it comprises aluminum, which may include pure aluminum and aluminum alloys such as Al—Mn, Al—Mg, Al—Cu, Al—Si, Al—Mg—Si and Al—Cu—Si types. Stated more specifically, aluminum of 6000 types such as JIS A6063 and aluminum of 3000 types such as JIS A3003 may be used. There are also no particular limitations on its shape. It may preferably be in the form of a drum.

The chlorogallium phthalocyanine used in the present invention has a structure represented by the following formula.

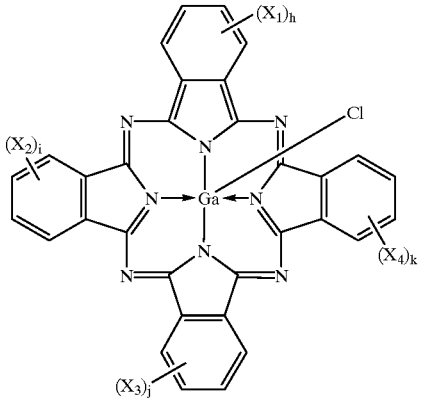

wherein $X_1$, $X_2$, $X_3$ and $X_4$ each represent Cl or Br; and h, i, j and k each represent an integer of 0 to 4.

Figure 3:
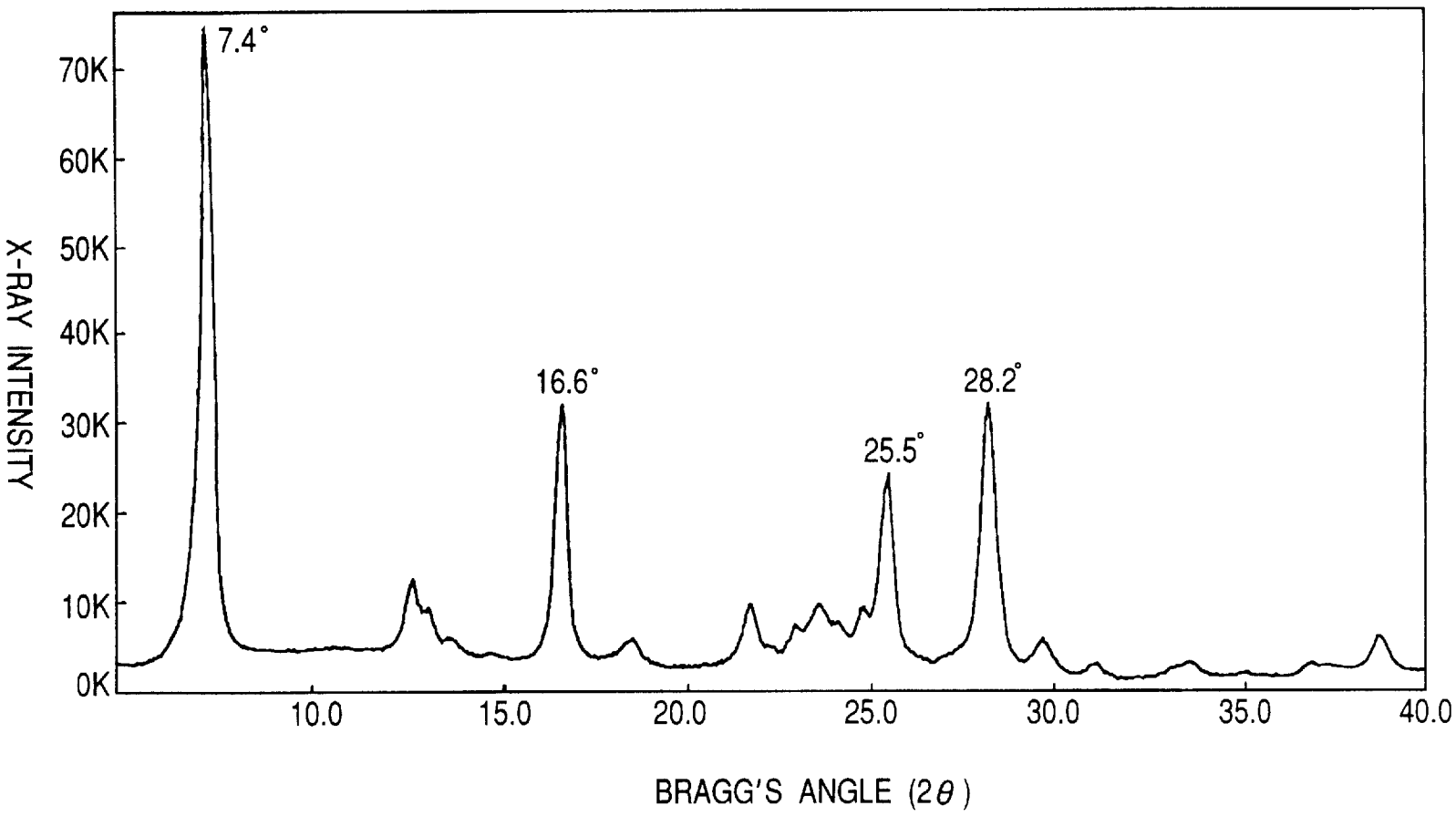
FIG. 3 is an X-ray diffraction pattern of chlorogallium phthalocyanine.
Figure 4:
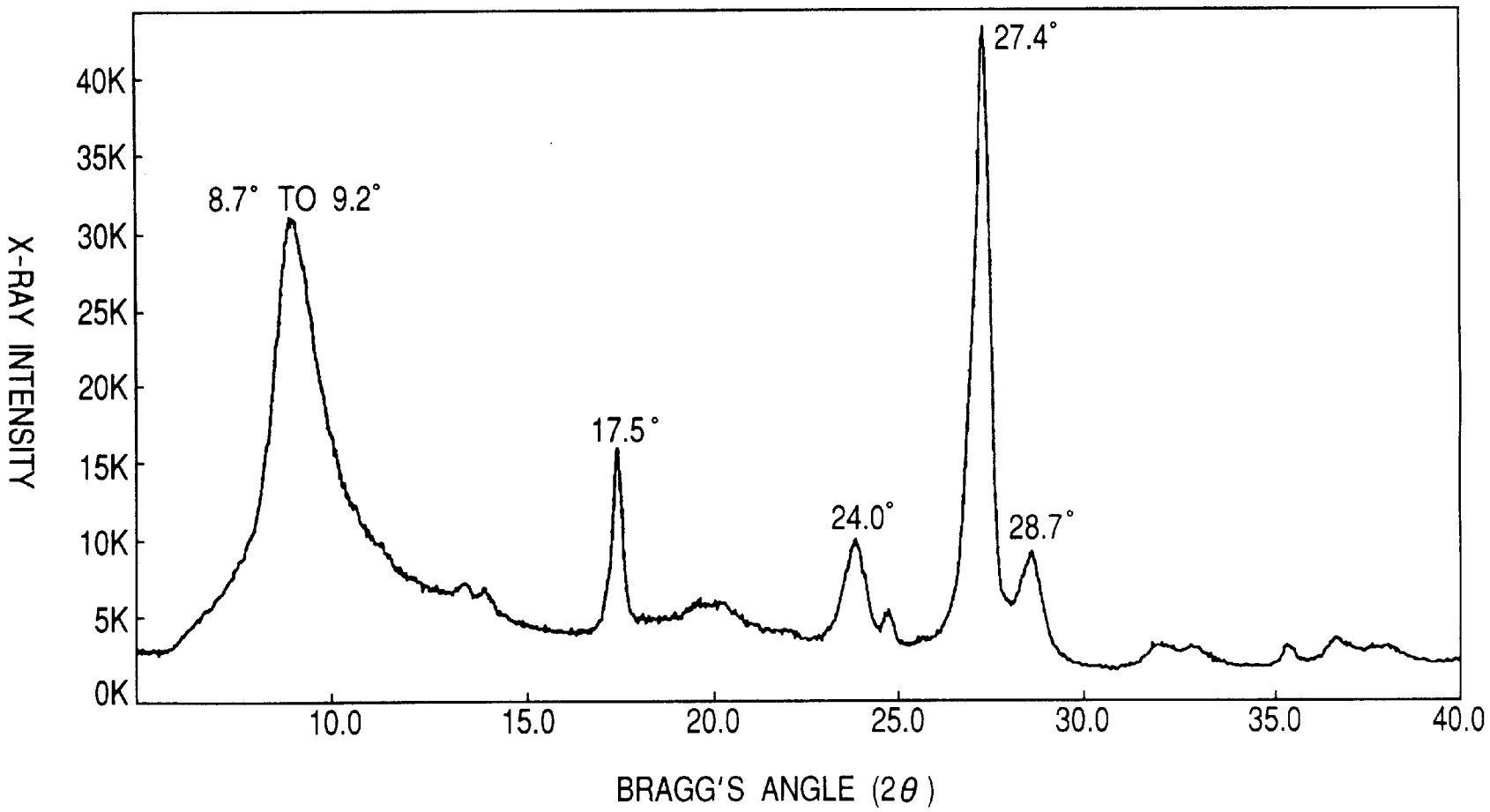
FIG. 4 is an X-ray diffraction pattern of chlorogallium phthalocyanine.

In the present invention, particularly preferred is a chlorogallium phthalocyanine having a crystal form shown in the following (A) or (B):

(A) A chlorogallium phthalocyanine having the intense peaks at 7.4°, 16.6°, 25.5° and 28.2° of the Bragg's angle (2θ±0.2°) in CuKα-characteristic X-ray diffraction (FIG. 3, as disclosed in Japanese Patent Application Laid-open No. 5-98181);

(B) A chlorogallium phthalocyanine having the intense peaks at 8.7°–9.2°, 17.5°, 24.0°, 27.4° and 28.7° of the Bragg's angle (2θ±0.2°) in CuKα-characteristic X-ray diffraction (FIG. 4, as disclosed in Japanese Patent Application Laid-open No. 5-98181).

The hydroxygallium phthalocyanine used in the present invention has a structure represented by the following formula:

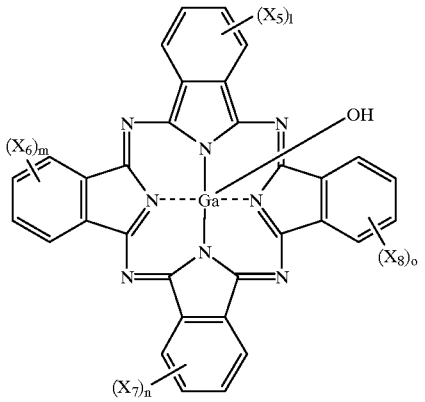

wherein $X_5$, $X_6$, $X_7$ and $X_8$ each represent Cl or Br; and l, m, n and o each represent an integer of 0 to 4.

Figure 5:
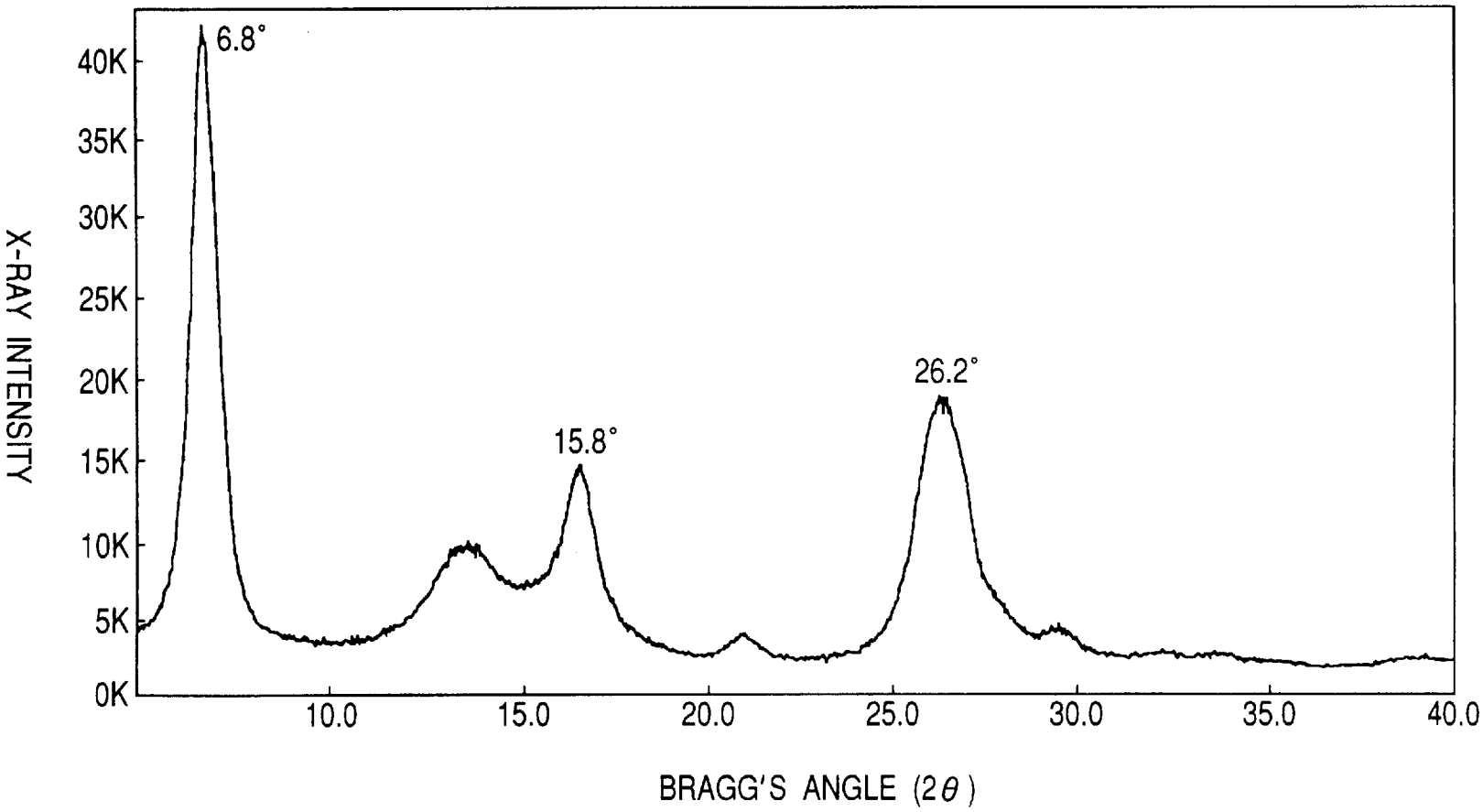
FIG. 5 is an X-ray diffraction pattern of hydroxygallium phthalocyanine.
Figure 6:
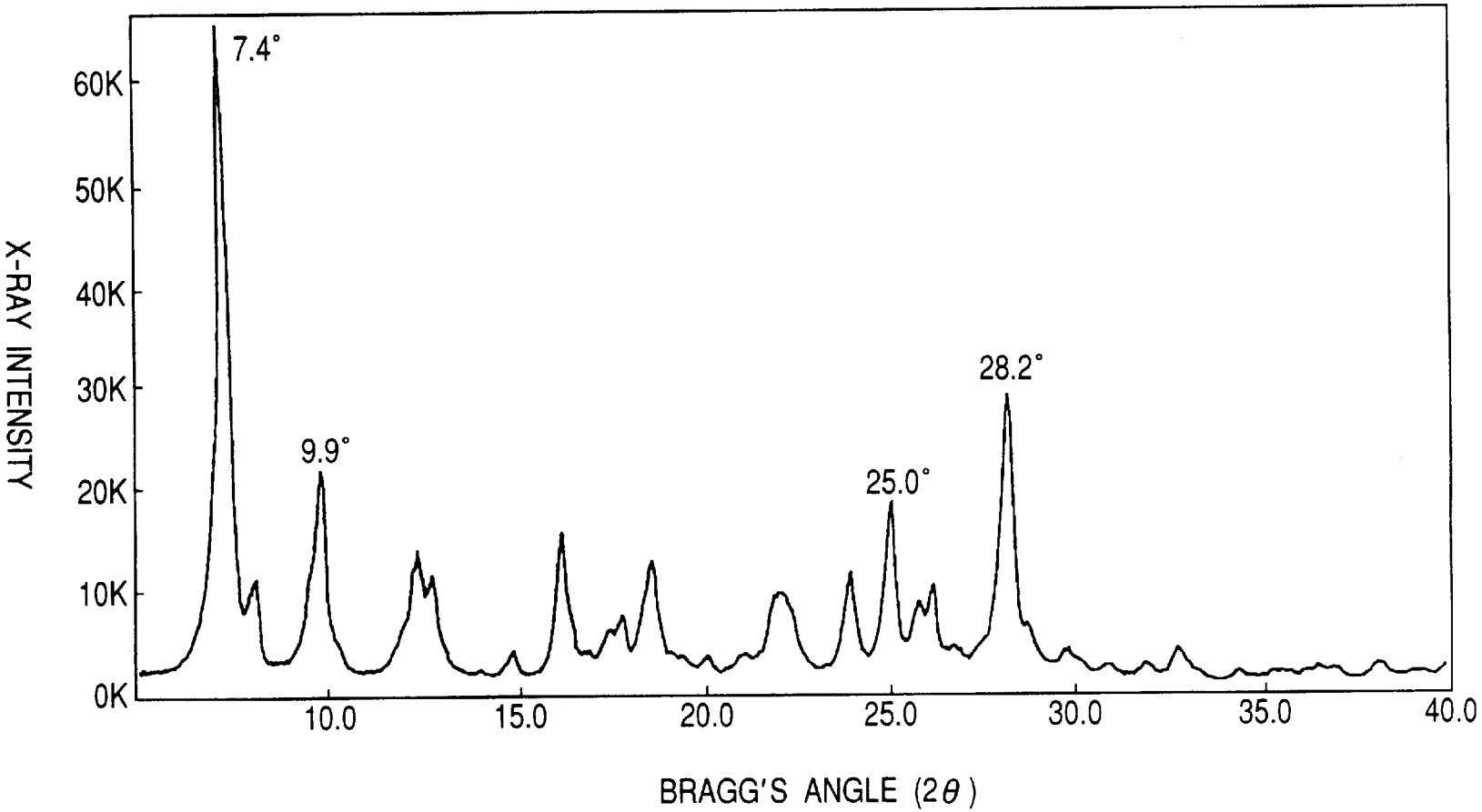
FIG. 6 is an X-ray diffraction pattern of hydroxygallium phthalocyanine.
Figure 7:
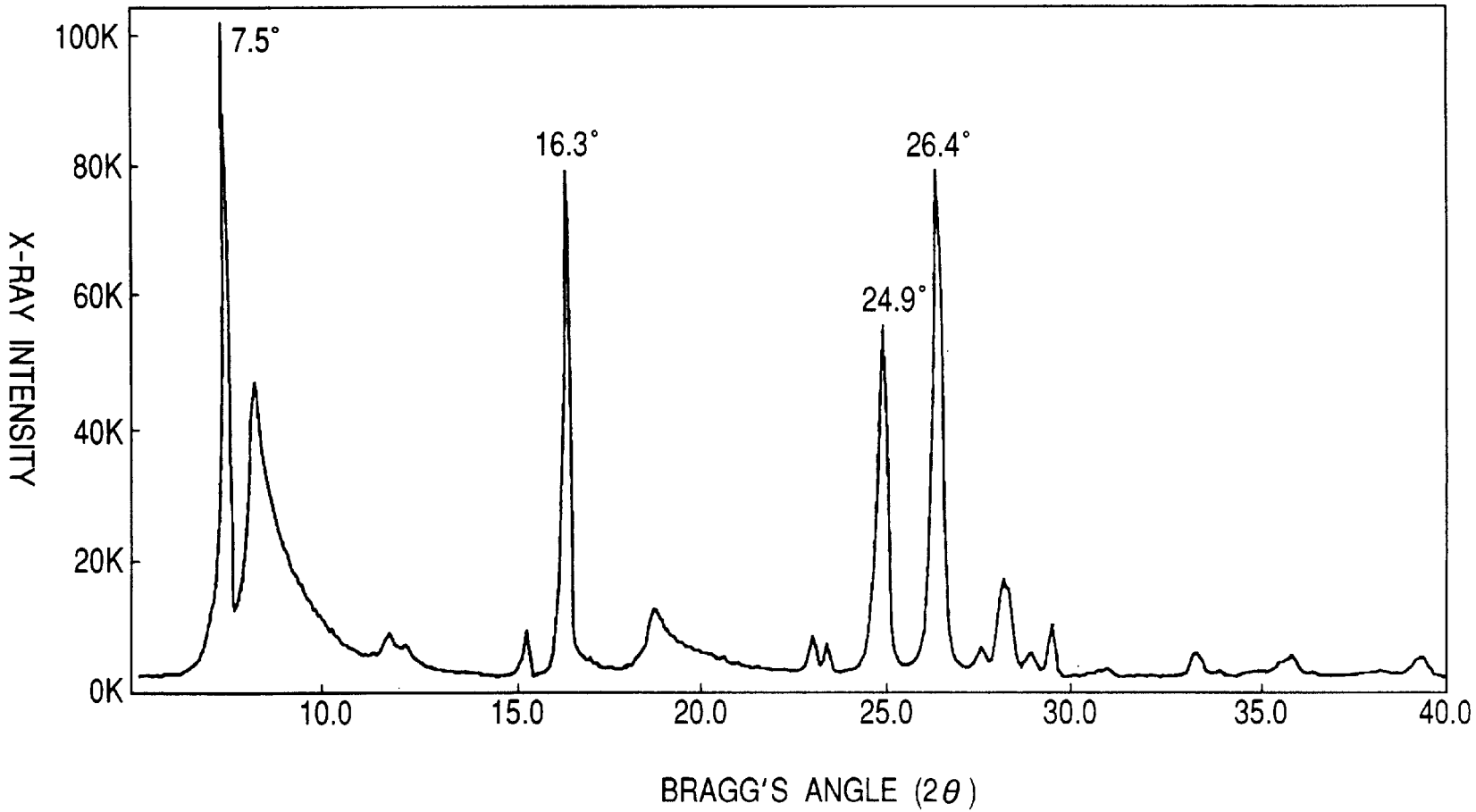
FIG. 7 is an X-ray diffraction pattern of a hydroxygallium phthalocyanine.
Figure 8:
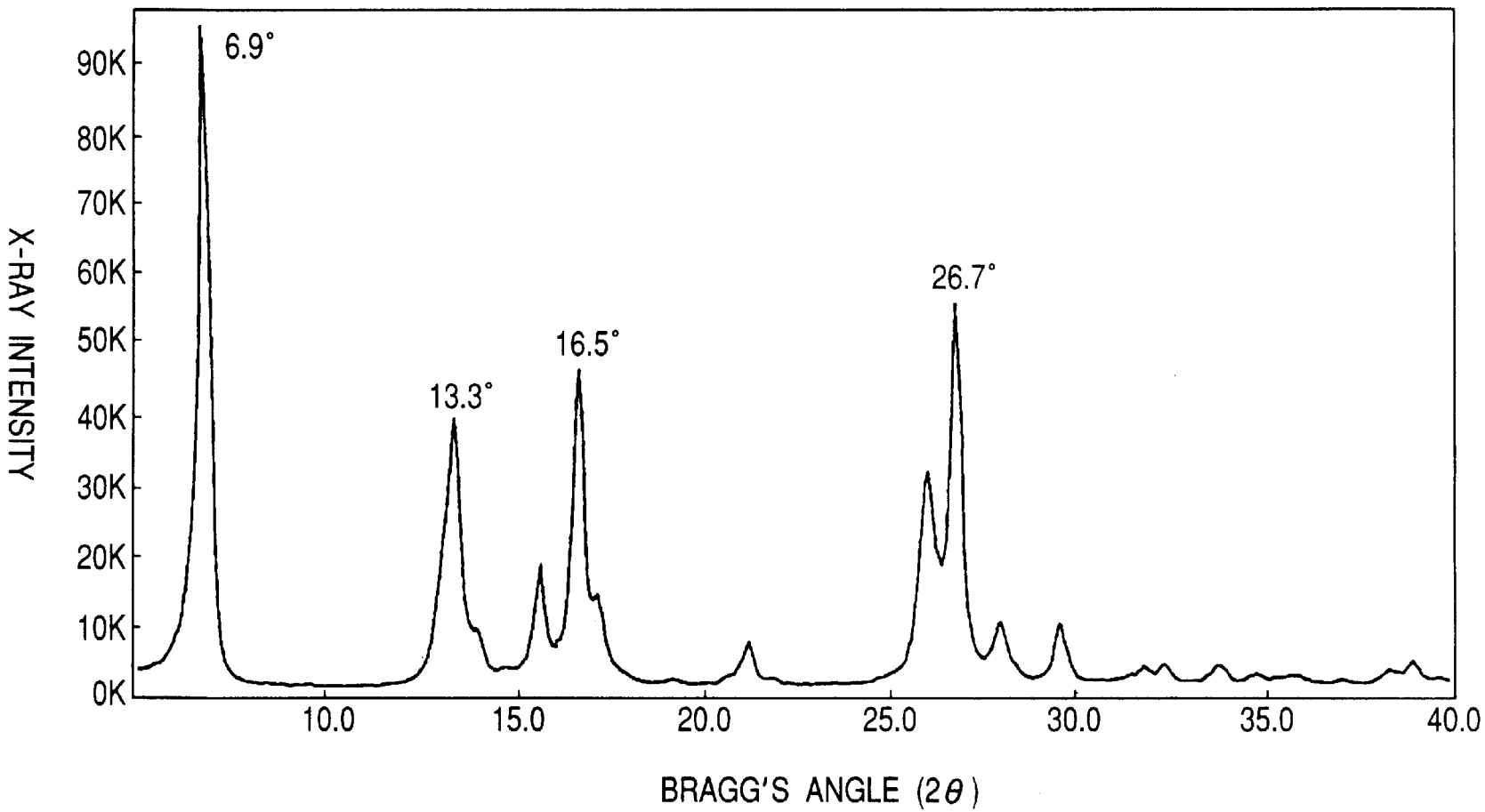
FIG. 8 is an X-ray diffraction pattern of a hydroxygallium phthalocyanine.

In the present invention, particularly preferred is a hydroxygallium phthalocyanine having a crystal form shown in any of the following (C) to (F):

(C) A hydroxygallium phthalocyanine having the intense peaks at 6.8°, 15.8° and 26.2° of the Bragg's angle (2θ±0.2°) in CuKα characteristic X-ray diffraction (FIG. 5, as disclosed in Japanese Patent Application Laid-open No. 5-263007);

(D) A hydroxygallium phthalocyanine having the intense peaks at 7.4°, 9.9°, 25.0° and 28.2° of the Bragg's angle (2θ±0.2°) in CuKα characteristic X-ray diffraction (FIG. 6, as disclosed in Japanese Patent Application Laid-open No. 5-263007);

(E) A hydroxygallium phthalocyanine having the intense peaks at 7.5°, 16.3°, 24.9° and 26.4° of the Bragg's angle (2θ±0.2°) in CuKα characteristic X-ray diffraction (FIG. 7, as disclosed in Japanese Patent Application Laid-open No. 5-263007);

(F) A hydroxygallium phthalocyanine having the intense peaks at 6.9°, 13.3°, 16.5° and 26.7° of the Bragg's angle (2θ±0.2°) in CuKα characteristic X-ray diffraction (FIG. 8, as disclosed in Japanese Patent Application Laid-open No. 6-279698).

The oxytitanium phthalocyanine used in the present invention has a structure represented by the following formula:

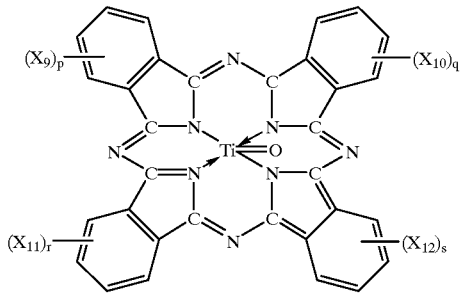

wherein $X_9$, $X_{10}$, $X_{11}$ and $X_{12}$ each represent Cl or Br; and p, q, r and s each represent an integer of 0 to 4.

As described previously, the oxytitanium phthalocyanine used in the present invention has the intense peaks at the Bragg's angles (2θ±0.2°) shown in any one of the following groups a) to e) in CuKα-characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.4°.

Figure 9:
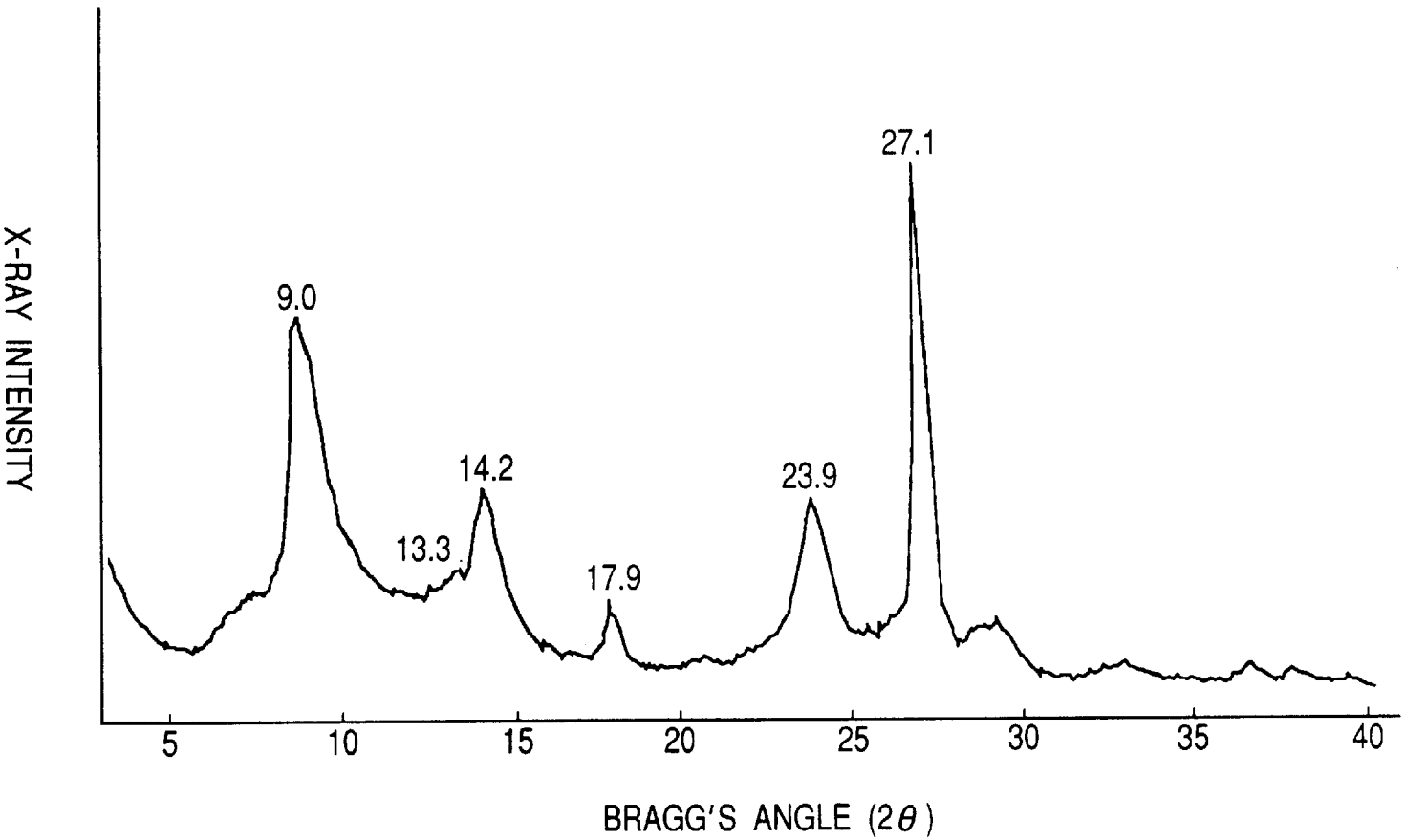
FIG. 9 is an X-ray diffraction pattern of oxytitanium phthalocyanine having an intense peak at each of the angles shown in the group a).
Figure 10:
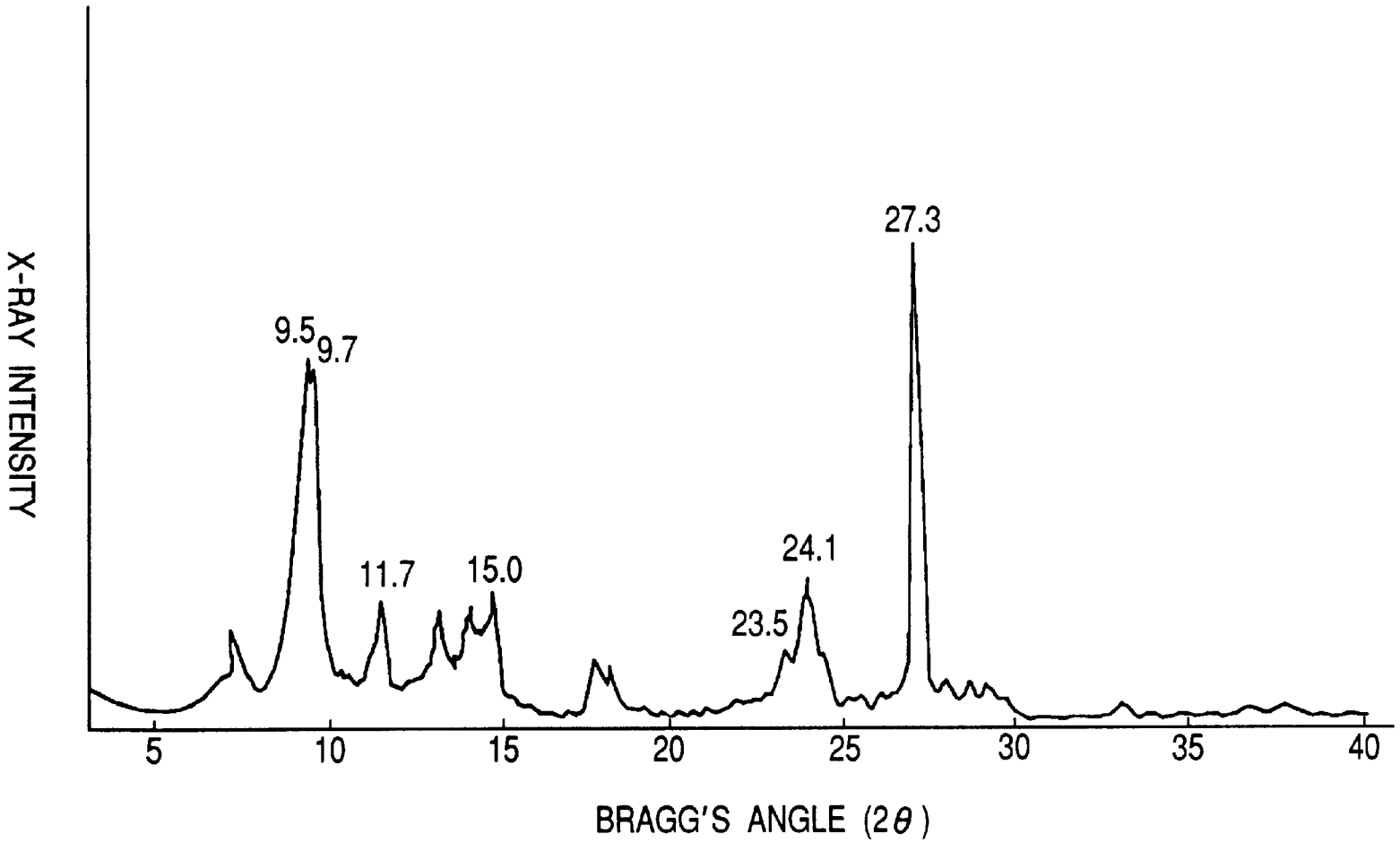
FIG. 10 is an X-ray diffraction pattern of an oxytitanium phthalocyanine having an intense peak at each of the angles shown in the group b).
Figure 11:
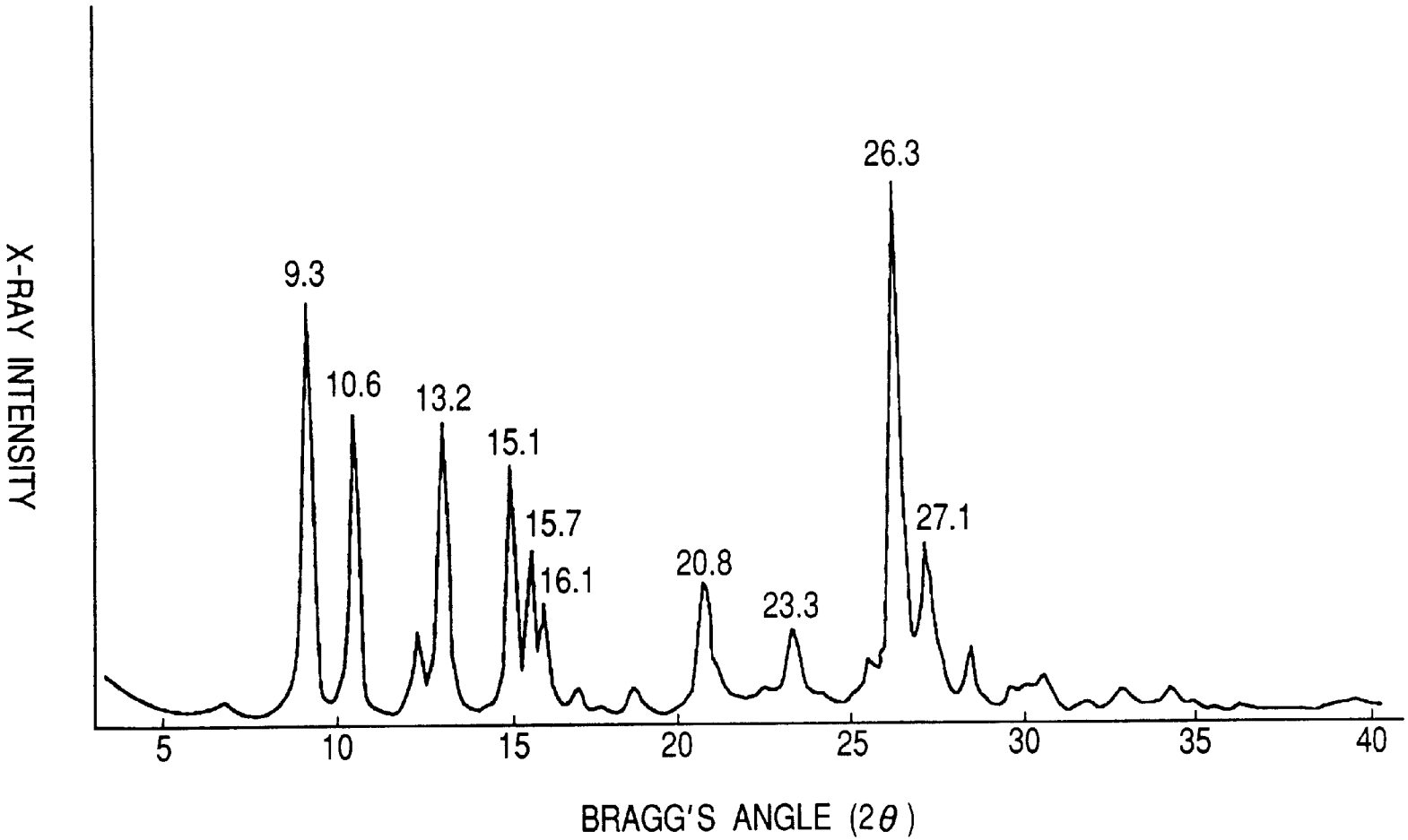
FIG. 11 is an X-ray diffraction pattern of an oxytitanium phthalocyanine having an intense peak at the each of the angles shown in the group c).
Figure 12:
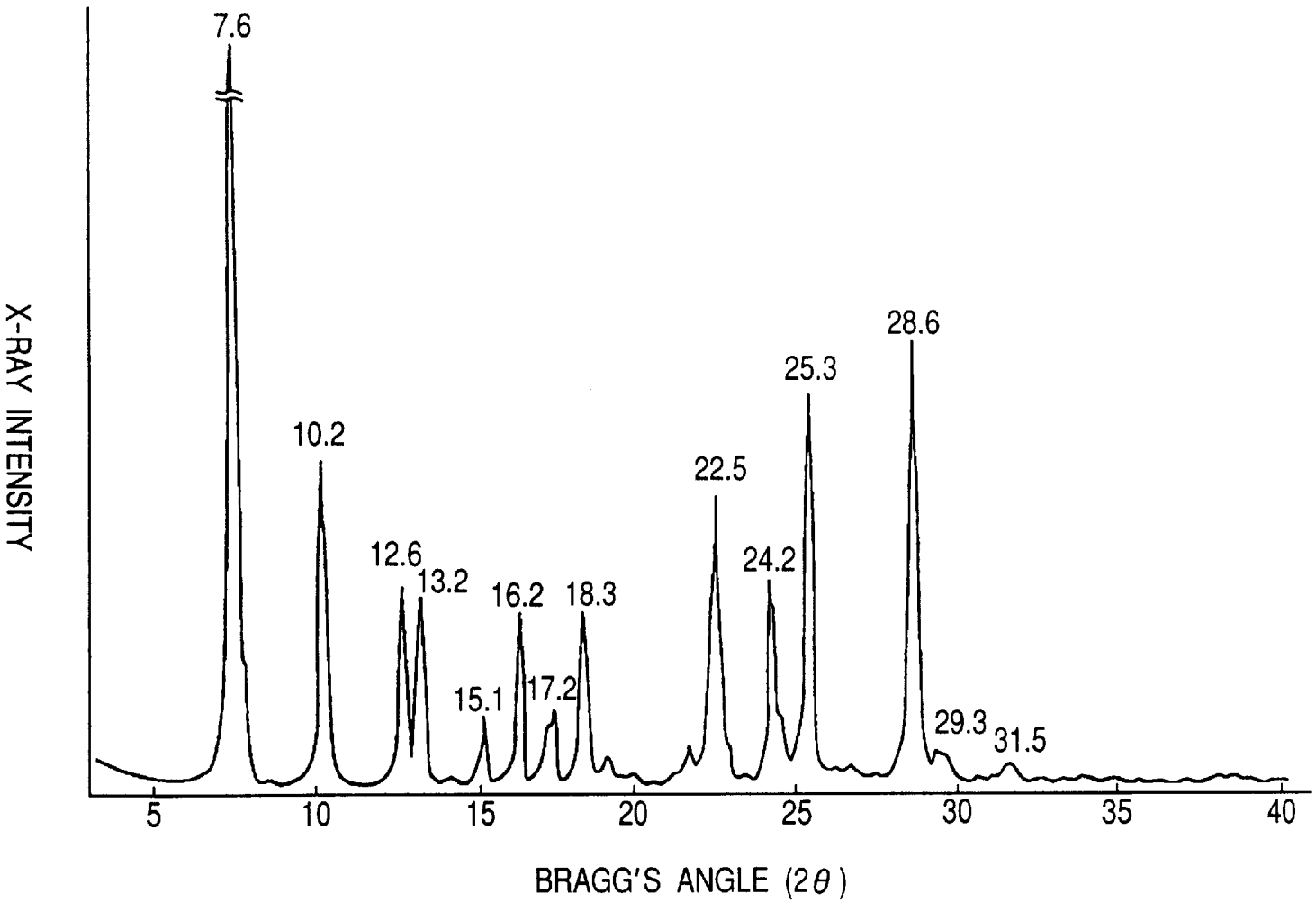
FIG. 12 is an X-ray diffraction pattern of an oxytitanium phthalocyanine having an intense peak at each of the angles shown in the group d).
Figure 13:
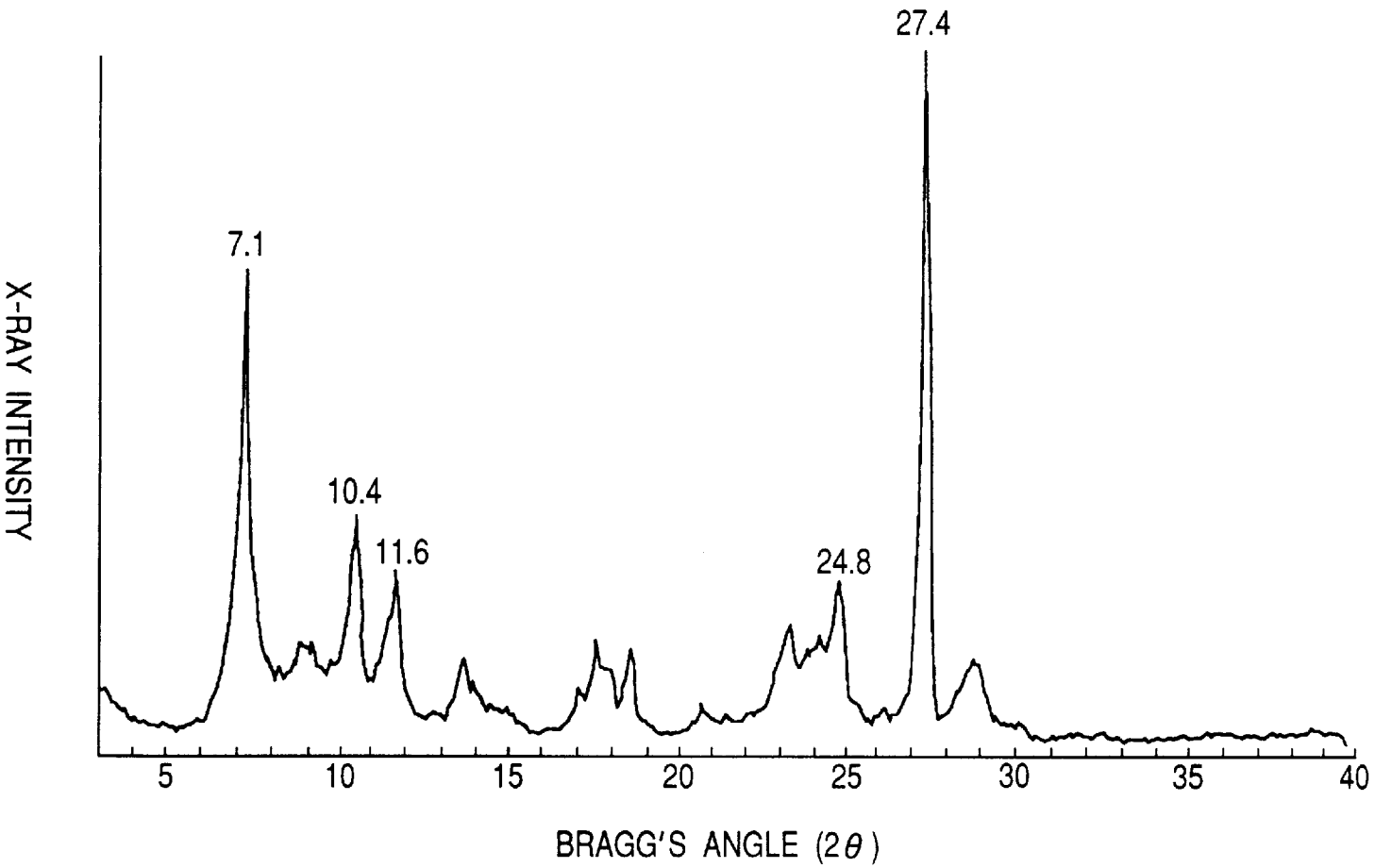
FIG. 13 is an X-ray diffraction pattern of an oxytitanium phthalocyanine having an intense peak at each of the angles shown in the group e).

The oxytitanium phthalocyanine having the intense peaks at the positions shown in the group a) (FIG. 9) is disclosed in Japanese Patent Application Laid-open No. 3-128973; the oxytitanium phthalocyanine having the intense peaks at the positions shown in the group b) (FIG. 10), in Japanese Patent Application Laid-open No. 1-17066; the oxytitanium phthalocyanine having the intense peaks at the positions shown in the group c) (FIG. 11), in Japanese Patent Application Laid-open No. 62-67094; the oxytitanium phthalocyanine having the intense peaks at the positions shown in the group d) (FIG. 12), in Japanese Patent Application Laid-open No. 61-239248; and the oxytitanium phthalocyanine having the intense peaks at the positions shown in the group e) (FIG. 13), in Japanese Patent Application Laid-open No. 3-54265.

Of these, the oxytitanium phthalocyanine having the intense peaks at the positions shown in the group a) is particularly preferred.

The photosensitive layer of the electrophotographic photosensitive member used in the present invention will be described below.

Constitution of the photosensitive layer in the present invention is grouped roughly into a single-layer type in which a charge-generating material and a charge-transporting material are contained in the same layer and a multi-layer type having a charge generation layer containing a charge-generating material and a charge transport layer containing a charge-transporting material. The latter is preferred.

An electrophotographic photosensitive member having the multi-layer type photosensitive layer will be described below.

The photosensitive member may be constituted in such a manner that the charge generation layer and the charge transport layer are layered on the substrate in this order or conversely the charge transport layer and the charge generation layer are layered in this order. The former is preferred.

The charge generation layer is formed by coating a dispersion prepared by dispersing the above oxytitanium phthalocyanine as a charge-generating material together with a suitable binder resin and a solvent, followed by drying.

The binder resin may include, e.g., polyester resins, acrylic resins, phenoxy resins, polyvinyl acetal resins, polystyrene resins and polyallylate resins. The dispersion is carried out by, e.g., using a milling machine such as a paint shaker, a sand mill or a ball mill or a high-pressure liquid collision dispersion machine together with dispersion media such as glass beads, steel beads or aluminum beads. The oxytitanium phthalocyanine and binder resin in the charge generation layer may preferably be in a weight ratio of from 10:1 to 1:5, and particularly preferably from 5:1 to 1:2. Also, the charge generation layer may preferably have a layer thickness of from 0.01 to 5 μm, and particularly preferably from 0.05 to 1 μm.

The charge transport layer is formed by coating a solution prepared by dissolving a charge-transporting material and a binder resin in a suitable solvent, followed by drying.

The charge-transporting material may include, e.g., arylamine compounds, hydrazone compounds, stilbene compounds and pyrazoline compounds. The binder resin may include, e.g., polyester resins, acrylic resins, phenoxy resins, polycarbonate resins, polyvinyl acetal resins, polystyrene resins and polyallylate resins. Also, the charge transport layer may preferably have a layer thickness of from 5 to 40 μm, and particularly preferably from 10 to 30 μm.

The single-layer type photosensitive layer is formed by applying a coating fluid prepared by dispersing and dissolving the charge-generating material and the charge-transporting material in the resin, followed by drying. Such a photosensitive layer may preferably have a layer thickness of from 5 to 40 μm, and preferably from 10 to 30 μm.

In the present invention, a subbing layer having the function as a barrier and the function of adhesion may be provided between the support and the photosensitive layer. The subbing layer is formed by applying a solution prepared by dissolving casein, nitro cellulose, ethylene-acrylic acid copolymer, alcohol-soluble polyamide, polyurethane or gelatin, followed by drying.

The subbing layer may preferably have a layer thickness of from 0.1 to 3 μm.

In the present invention, a protective layer may be provided on the photosensitive layer.

The protective layer may be constituted of a material including polyester, polyacrylate, polyethylene, polystyrene, polybutadiene, polycarbonate, polyamide, polypropylene, polyimide, polyamide-imide, polysulfone, polyacrylic ether, polyacetal, phenol, acrylic, silicone, epoxy, urea, allyl, alkyd, butyral, phenoxy, phosphazene, acryl-modified epoxy, acryl-modified urethane and acryl-modified polyester resins.

The protective layer may preferably have a layer thickness of from 0.2 to 10 μm.

In each of the above layers, a lubricant such as polytetrafluoroethylene, polyvinylidene fluoride, fluorine type graft polymer, silicone type graft polymer, fluorine type block polymer, silicone type block polymer or silicone oil may be incorporated in order to improve cleaning performance and wear resistance.

Additives such as an antioxidant may further be added for the purpose of improving weatherability.

In the protective layer, conductive powder such as a conductive tin oxide or conductive titanium oxide may be dispersed for the purpose of resistance control.

FIG. 1 schematically illustrates the construction of an electrophotographic apparatus having a process cartridge having the electrophotographic photosensitive member of the present invention.

In FIG. 1, reference numeral 1 denotes a drum type electrophotographic photosensitive member of the present invention, which is rotatively driven around an axis 2 in the direction of an arrow at a given peripheral speed. The photosensitive member 1 is electrostatically charged uniformly on its periphery to a positive or negative, given potential through a primary charging means 3. The photosensitive member thus charged is then exposed to light 4 emitted from an 5 exposure means (not shown) for slit exposure or laser beam scanning exposure. In this way, electrostatic latent images are formed successively on the periphery of the photosensitive member 1.

The electrostatic latent images thus formed are subsequently developed by toner by the operation of a developing means 5. The toner-developed images formed by development are then transferred successively by the operation of a transfer means 6, to the surface of a transfer medium 7 fed from a paper feed section (not shown) to the part between the photosensitive member 1 and the transfer means 6 in such a manner as synchronized with the rotation of the photosensitive member 1.

The transfer medium 7 which has received the images is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. When the primary charging means is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, liquid-crystal printers and laser beam engravers.

The present invention will be described below in greater detail by giving Examples.

EXAMPLE 1

An aluminum cylinder of 29.92 mm in outer diameter, 28.5 mm in inner diameter and 254 mm in length was prepared as a substrate.

An aqueous acid solution (trade name: PALCOAT 3753, available from Nihon Parkerizing Co., Ltd.; pH: 3.8) containing phytic acid as an organic phosphoric acid and titanium hydrofluoride and ammonium titanium fluoride as salts of metals was kept at a temperature of 40° C., and the above aluminum cylinder was immersed in this aqueous acid solution to make chemical conversion for 1 minute, which was then washed with pure water, followed by air-drying. The chemical conversion coating thus formed was in a layer thickness of 200 Å.

Next, 10 parts by weight of the chlorogallium phthalocyanine of type (A) as a charge-generating material, 10 parts by weight of polyvinyl butyral resin (trade name: BX-1, available from Sekisui Chemical Co. Ltd.) and 400 parts by weight of cyclohexanone were dispersed for 5 hours by means of a sand mill, followed by addition of 400 parts by weight of ethyl acetate to make up a charge generation layer coating dispersion.

This dispersion was dip-coated on the aluminum cylinder having been subjected to chemical conversion, followed by drying with heating at 80° C. for 10 minutes to form a charge generation layer with a layer thickness of 0.2 $\mu$m.

Next, a solution prepared by dissolving 10 parts by weight of a triarylamine compound represented by the following formula and 50 parts by weight of polycarbonate resin (weight-average molecular weight: 46,000) in a mixed solvent of 50 parts by weight of monochlorobenzene and 20 parts by weight of dichloromethane was dip-coated on the charge generation layer, followed by drying with heating at 110° C. for 1 hour to form a charge transport layer with a layer thickness of 20 $\mu$m.

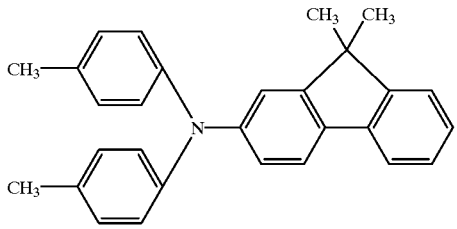

Figure 2:
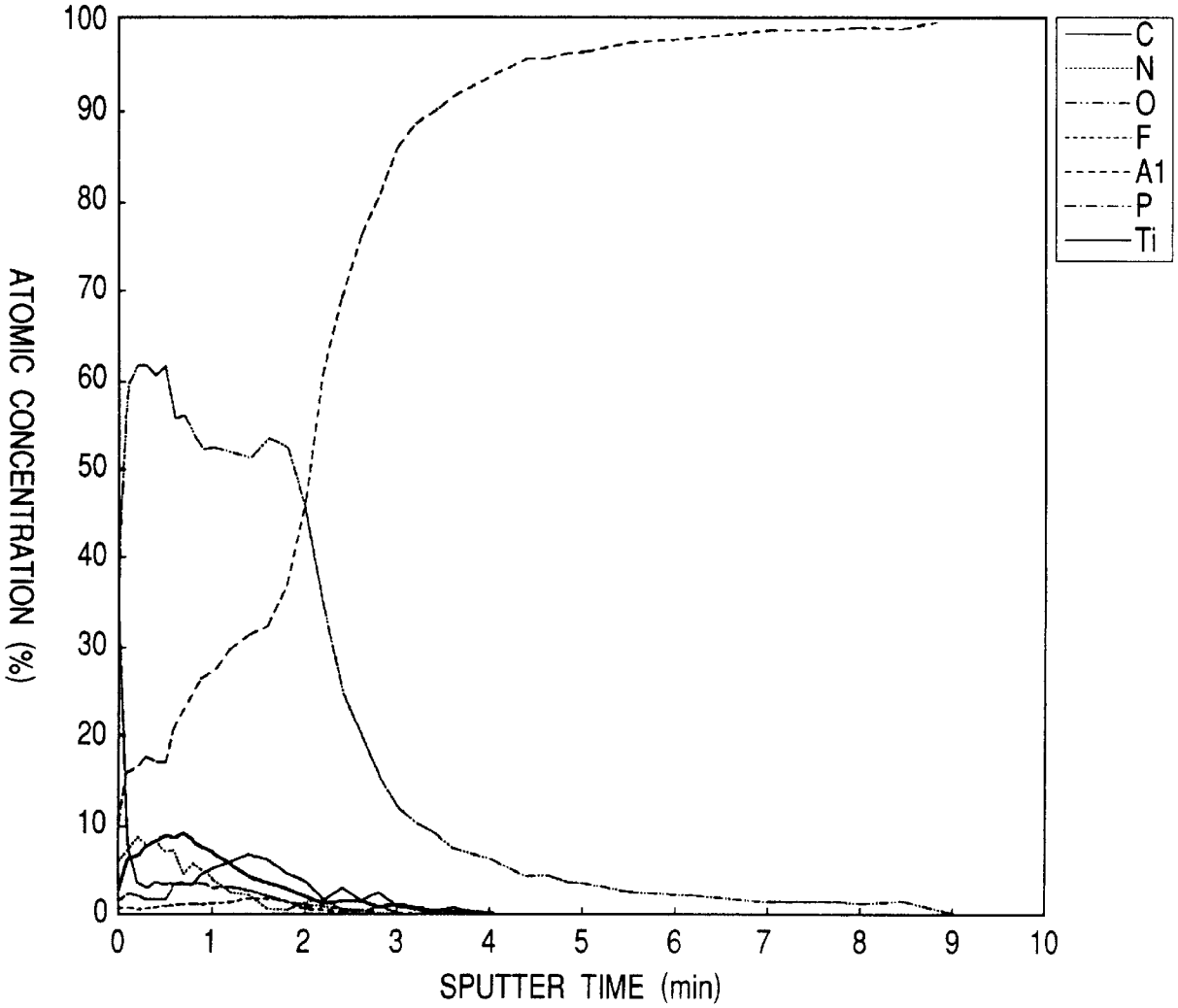
FIG. 2 is a graph showing the compositional ratio of elements constituting the surface portion of an aluminum substrate the electrophotographic photosensitive member of the present invention has.

The surface portion of the substrate having been subjected to chemical conversion, washing and drying was examined by elementary analysis using a scanning Auger electron ray spectroscope while making argon ion etching from the uppermost surface in the depth direction of the substrate. As the result, aluminum, titanium and oxygen were detected as main constituent elements. Their graphic representation is given in FIG. 2.

In the present Example, the relationship between depth and sputter time is 110 Å/min in terms of $SiO_2$. This value is appropriately changeable.

The compositional ratio of elements at the uppermost surface of the substrate and at a depth of 50 Å from the uppermost surface is shown in Table 1 as elementary percentage regarding the amount of aluminum element as 100.

As can be seen from these results, the chemical conversion coating on the substrate surface comprises an aluminum oxide coating in which titanium has been incorporated. As the result of analysis, nitrogen, fluorine, phosphorus and so forth are detected as other elements contained. These elements are considered to be those originally contained in the phosphoric acid and fluorine compound in the aqueous acid solution used when the chemical conversion is made, and incorporated in the chemical conversion coating.

Next, the electrophotographic photosensitive member obtained was left standing for 48 hours in an environment of normal temperature/normal humidity (23° C., 50%RH), high temperature/high humidity (33° C., 80%RH) or low temperature/low humidity (15° C., 10%RH), and thereafter set in a commercially available laser beam printer of a reverse development system to reproduce solid white images in each environment. Its light source was 780 nm in wavelength and 0.35 $\mu J/cm^2$ in light amount. Dark-area potential (Vd) at the initial stage was set at −700 V.

The initial dark-area potential (Vd) and the initial light-area potential were measured, and image quality was visually evaluated. Results obtained are shown in Table 2. Also, an image reproduction running test was made on 5,000 sheets continuously, and the amount of changes in the dark-area potential and light-area potential from those at the initial stage (ΔVd, ΔVl) and image quality were evaluated. Results obtained are shown in Table 3. In the table, the minus signs in the data of the amount of changes indicate a decrease in the absolute value of potential, and the plus signs indicate an increase in the absolute value of potential.

EXAMPLE 2

An electrophotographic photosensitive member was produced in the same manner as in Example 1 except that the chlorogallium phthalocyanine of type (B) was used as the charge-generating material. Evaluation was also made in the same way. Results obtained are shown in Tables 2 and 3.

EXAMPLE 3

An electrophotographic photosensitive member was produced in the same manner as in Example 1 except that the hydroxygallium phthalocyanine of type (C) was used as the charge-generating material. Evaluation was also made in the same way. Results obtained are shown in Tables 2 and 3.

EXAMPLE 4

An electrophotographic photosensitive member was produced in the same manner as in Example 1 except that the hydroxygallium phthalocyanine of type (D) was used as the charge-generating material. Evaluation was also made in the same way. Results obtained are shown in Tables 2 and 3.

EXAMPLE 5

An electrophotographic photosensitive member was produced in the same manner as in Example 1 except that the hydroxygallium phthalocyanine of type (E) was used as the charge-generating material. Evaluation was also made in the same way. Results obtained are shown in Tables 2 and 3.

EXAMPLE 6

An electrophotographic photosensitive member was produced in the same manner as in Example 1 except that the hydroxygallium phthalocyanine of type (F) was used as the charge-generating material. Evaluation was also made in the same way. Results obtained are shown in Tables 2 and 3.

EXAMPLE 7

An electrophotographic photosensitive member was produced in the same manner as in Example 1 except that a solution (trade name: PALCOAT 3756, available from Nihon Parkerizing Co., Ltd.; pH: 3.2) containing tannic acid, an ammonium salt and zirconium fluoride and zirconium sulfate as salts of metals was used as the aqueous acid solution for chemical conversion. Evaluation was made in the same way. The results are shown in Tables 1 to 3. The chemical conversion coating was in a layer thickness of 150 Å.

EXAMPLE 8

An electrophotographic photosensitive member was produced in the same manner as in Example 1 except that a solution (trade name: PALCOAT 3753T, available from Nihon Parkerizing Co., Ltd.; pH: 3.5) containing phytic acid and containing zircon hydrofluoride and ammonium zircon fluoride as salts of metals was used as the aqueous acid solution for chemical conversion. Evaluation was made in the same way. The results are shown in Tables 1 to 3. The chemical conversion coating was in a layer thickness of 180 Å.

EXAMPLE 9

An electrophotographic photosensitive member was produced in the same manner as in Example 1 except that a solution (trade name: ALSURF 301N-1, available from Nihon Paint Co., Ltd.; pH: 4.0) containing phosphoric acid and containing zirconium fluoride and sodium zircon hydrofluoride as salts of metals was used as the aqueous acid solution for chemical conversion. Evaluation was made in the same way. The results are shown in Tables 1 to 3. The chemical conversion coating was in a layer thickness of 300 Å.

COMPARATIVE EXAMPLE 1

An electrophotographic photosensitive member was produced in the same manner as in Example 1 except that the chemical conversion was not carried out. Evaluation was made in the same way. The results are shown in Tables 2 and 3.

COMPARATIVE EXAMPLE 2

Chemical conversion was carried out by immersing an aluminum cylinder for I minute in, in place of the aqueous acid solution used in the present invention, a solution (trade name: ALCHROME 3701, available from Nihon Parkerizing Co., Ltd.) containing neither titanium nor zirconium and kept at a liquid temperature of 30° C., to form a chromate-type chemical conversion coating on the surface of the cylinder.

An electrophotographic photosensitive member was produced in the same manner as in Example 1 except that this aluminum cylinder was used instead. Evaluation was made in the same way. The results are shown in Tables 2 and 3.

COMPARATIVE EXAMPLE 3

Ammonia water with a concentration of 0.3% was prepared, and this was heated to 95° C.

In this heated ammonia water, the same aluminum cylinder as that used in Example 1 and having not been subjected to chemical conversion was immersed to make surface treatment, followed by drying to form a boehmite coating on the cylinder surface.

An electrophotographic photosensitive member was produced in the same manner as in Example 1 except that this aluminum cylinder was used instead. Evaluation was made in the same way. The results are shown in Tables 2 and 3.

EXAMPLE 10

An electrophotographic photosensitive member was produced in the same manner as in Example 1 except that the oxytitanium phthalocyanine having the intense peaks at the positions shown in the group a) was used as the charge-generating material. Evaluation was also made in the same way. Results obtained are shown in Tables 4 and 5.

EXAMPLE 11

An electrophotographic photosensitive member was produced in the same manner as in Example 1 except that the oxytitanium phthalocyanine having the intense peaks at the positions shown in the group b) was used as the charge-generating material. Evaluation was also made in the same way. Results obtained are shown in Tables 4 and 5.

EXAMPLE 12

An electrophotographic photosensitive member was produced in the same manner as in Example 1 except that the oxytitanium phthalocyanine having the intense peaks at the positions shown in the group c) was used as the charge-generating material. Evaluation was also made in the same way. Results obtained are shown in Tables 4 and 5.

EXAMPLE 13

An electrophotographic photosensitive member was produced in the same manner as in Example 1 except that the oxytitanium phthalocyanine having the intense peaks at the positions shown in the group d) was used as the charge-generating material. Evaluation was also made in the same way. Results obtained are shown in Tables 4 and 5.

EXAMPLE 14

An electrophotographic photosensitive member was produced in the same manner as in Example 1 except that the oxytitanium phthalocyanine having the intense peaks at the positions shown in the group e) was used as the charge-generating material. Evaluation was also made in the same way. Results obtained are shown in Tables 4 and 5.

EXAMPLE 15

An electrophotographic photosensitive member was produced in the same manner as in Example 10 except that a solution (trade name: PALCOAT 3756, available from Nihon Parkerizing Co., Ltd.; pH: 3.2) containing tannic acid, an ammonium salt and zirconium fluoride and zirconium sulfate as salts of metals was used as the aqueous acid solution for chemical conversion. Evaluation was made in the same way. The results are shown in Tables 4 and 5. The chemical conversion coating was in a layer thickness of 150 Å.

EXAMPLE 16

An electrophotographic photosensitive member was produced in the same manner as in Example 10 except that a solution (trade name: PALCOAT 3753T, available from Nihon Parkerizing Co., Ltd.; pH: 3.5) containing phytic acid and containing zircon hydrofluoride and ammonium zircon fluoride as salts of metals was used as the aqueous acid solution for chemical conversion. Evaluation was made in the same way. The results are shown in Tables 4 and 5. The chemical conversion coating was in a layer thickness of 180 Å.

EXAMPLE 17

An electrophotographic photosensitive member was produced in the same manner as in Example 10 except that a solution (trade name: ALSURF 301N-1, available from Nihon Paint Co., Ltd.; pH: 4.0) containing phosphoric acid and containing zirconium fluoride and sodium zircon hydrofluoride as salts of metals was used as the aqueous acid solution for chemical conversion. Evaluation was made in the same way. The results are shown in Tables 4 and 5. The chemical conversion coating was in a layer thickness of 300 Å.

COMPARATIVE EXAMPLE 4

An electrophotographic photosensitive member was produced in the same manner as in Example 12 except that the chemical conversion was not carried out. Evaluation was made in the same way. The results are shown in Tables 4 and 5.

COMPARATIVE EXAMPLE 5

Chemical conversion was carried out by immersing an aluminum cylinder for 1 minute in, in place of the aqueous acid solution used in the present invention, a solution (trade name: ALCHROME 3701, available from Nihon Parkerizing Co., Ltd.) containing neither titanium nor zirconium and kept at a liquid temperature of 30° C., to form a chromate-type chemical conversion coating on the surface of the cylinder.

An electrophotographic photosensitive member was produced in the same manner as in Example 12 except that this aluminum cylinder was used instead. Evaluation was made in the same way. The results are shown in Tables 4 and 5.

COMPARATIVE EXAMPLE 6

Ammonia water with a concentration of 0.3% was prepared, and this was heated to 95° C.

In this heated ammonia water, the same aluminum cylinder as that used in Example 1 and having not been subjected to chemical conversion was immersed to make surface treatment, followed by drying to form a boehmite coating on the cylinder surface.

An electrophotographic photosensitive member was produced in the same manner as in Example 12 except that this aluminum cylinder was used instead. Evaluation was made in the same way. The results are shown in Tables 4 and 5.

TABLE 1

| Measured at: | Percentage of the number of atoms of each element to the number of aluminum atoms (atom %) | | | | | | | |
|---|---|---|---|---|---|---|---|---|
| | Aluminum | Titanium | Zirconium | Oxygen | Nitrogen | Fluorine | Phosphorus | Carbon |
| Example 1 | | | | | | | | |
| Uppermost surface: | 100 | 32.8 | — | 470 | 80.3 | 7.2 | 14.8 | 503.1 |
| 50 Å depth: | 100 | 64.2 | — | 389.6 | 63.4 | 6.7 | 13.4 | — |
| Example 7 | | | | | | | | |
| Uppermost surface: | 100 | — | 23.3 | 422.1 | — | 10.5 | 66.3 | 541.9 |
| 50 Å depth: | 100 | — | 10 | 185 | — | 8.8 | 9.1 | — |
| Example 8 | | | | | | | | |
| Uppermost surface: | 100 | — | 29.3 | 356.6 | 53.5 | 6.1 | — | 453.5 |
| 50 Å depth: | 100 | — | 51.6 | 320.7 | 43.1 | 4.8 | — | — |
| Example 9 | | | | | | | | |
| Uppermost surface: | 100 | — | 59 | 232.7 | 100 | 34 | 100 | 394.7 |
| 50 Å depth: | 100 | — | 95 | 916.7 | 20.8 | 8.3 | 45.8 | — |

Measuring device: A 670 xi type scanning Auge electron spectroscope manufactured by ULVAC-PHI. INC.; electron probe diameter: 0.1 μm or smaller. An argon ion gun was used in etching.

TABLE 2

| | Initial stage | | | | | | | | |
|---|---|---|---|---|---|---|---|---|---|
| | Normal temperature/ normal humidity | | | High temperature/ high humidity | | | Low temperature/ low humidity | | |
| | Vd (V) | V1 (V) | Image quality | Vd (V) | V1 (V) | Image quality | Vd (V) | V1 (V) | Image quality |
| Example: | | | | | | | | | |
| 1 | −700 | −195 | good | −695 | −190 | good | −700 | −205 | good |
| 2 | −700 | −220 | good | −695 | −210 | good | −700 | −230 | good |
| 3 | −700 | −225 | good | −695 | −215 | good | −700 | −230 | good |
| 4 | −700 | −155 | good | −700 | −150 | good | −700 | −160 | good |
| 5 | −700 | −170 | good | −700 | −165 | good | −700 | −175 | good |
| 6 | −700 | −210 | good | −695 | −205 | good | −700 | −220 | good |
| 7 | −700 | −200 | good | −695 | −195 | good | −700 | −210 | good |
| 8 | −695 | −205 | good | −695 | −200 | good | −700 | −210 | good |
| 9 | −700 | −200 | good | −695 | −195 | good | −700 | −210 | good |
| Comparative Example: | | | | | | | | | |
| 1 | −685 | −200 | black dots | −680 | −195 | black dots | −690 | −230 | black dots |
| 2 | −695 | −210 | good | −680 | −200 | black dots | −695 | −230 | good |
| 3 | −685 | −200 | black dots | −675 | −195 | black dots | −680 | −225 | black dots |

TABLE 3

| | After 5,000-sheet running | | | | | | | | |
|---|---|---|---|---|---|---|---|---|---|
| | Normal temperature/ normal humidity | | | High temperature/ high humidity | | | Low temperature/ low humidity | | |
| | ΔVd (V) | ΔV1 (V) | Image quality | ΔVd (V) | ΔV1 (V) | Image quality | ΔVd (V) | ΔV1 (V) | Image quality |
| Example: | | | | | | | | | |
| 1 | 0 | +10 | good | −5 | +10 | good | 0 | +15 | good |
| 2 | −5 | +15 | good | −5 | +10 | good | −5 | +15 | good |
| 3 | 0 | +10 | good | 0 | +5 | good | 0 | +15 | good |
| 4 | 0 | +5 | good | 0 | +5 | good | 0 | +10 | good |
| 5 | 0 | +5 | good | 0 | +5 | good | 0 | +10 | good |
| 6 | −5 | +10 | good | 0 | +5 | good | 0 | +15 | good |
| 7 | 0 | +5 | good | −5 | +5 | good | −5 | +10 | good |
| 8 | 0 | +10 | good | −5 | +5 | good | −5 | +10 | good |
| 9 | 0 | +10 | good | −5 | +10 | good | 0 | +15 | good |

TABLE 3-continued

| | After 5,000-sheet running | | | | | | | | |
|---|---|---|---|---|---|---|---|---|---|
| | Normal temperature/ normal humidity | | | High temperature/ high humidity | | | Low temperature/ low humidity | | |
| | ΔVd (V) | ΔV1 (V) | Image quality | ΔVd (V) | ΔV1 (V) | Image quality | ΔVd (V) | ΔV1 (V) | Image quality |
| Comparative Example: | | | | | | | | | |
| 1 | −25 | +30 | black dots | −40 | +25 | black dots | −30 | +45 | black dots |
| 2 | −15 | +30 | black dots | −35 | +25 | black dots | −30 | +50 | black dots |
| 3 | −15 | +25 | black dots | −35 | +30 | black dots | −35 | +40 | black dots |

TABLE 4

| | Initial stage | | | | | | | | |
|---|---|---|---|---|---|---|---|---|---|
| | Normal temperature/ normal humidity | | | High temperature/ high humidity | | | Low temperature/ low humidity | | |
| | Vd (V) | V1 (V) | Image quality | Vd (V) | V1 (V) | Image quality | Vd (V) | V1 (V) | Image quality |
| Example: | | | | | | | | | |
| 10 | −700 | −170 | good | −695 | −165 | good | −700 | −180 | good |
| 11 | −700 | −185 | good | −695 | −180 | good | −700 | −200 | good |
| 12 | −695 | −230 | good | −690 | −225 | good | −700 | −250 | good |
| 13 | −700 | −240 | good | −695 | −230 | good | −700 | −245 | good |
| 14 | −700 | −200 | good | −695 | −195 | good | −700 | −210 | good |
| 15 | −700 | −170 | good | −695 | −165 | good | −705 | −180 | good |
| 16 | −695 | −170 | good | −695 | −165 | good | −700 | −175 | good |
| 17 | −700 | −170 | good | −695 | −165 | good | −700 | −180 | good |
| Comparative Example: | | | | | | | | | |
| 4 | −680 | −225 | black dots | −650 | −200 | black dots | −680 | −245 | black dots |
| 5 | −695 | −230 | good | −675 | −225 | black dots | −690 | −250 | good |
| 6 | −680 | −220 | black dots | −660 | −220 | black dots | −680 | −250 | black dots |

TABLE 5

| | After 5,000-sheet running | | | | | | | | |
|---|---|---|---|---|---|---|---|---|---|
| | Normal temperature/ normal humidity | | | High temperature/ high humidity | | | Low temperature/ low humidity | | |
| | ΔVd (V) | ΔV1 (V) | Image quality | ΔVd (V) | ΔV1 (V) | Image quality | ΔVd (V) | ΔV1 (V) | Image quality |
| Example: | | | | | | | | | |
| 10 | 0 | −10 | good | −5 | −10 | good | 0 | −15 | good |
| 11 | 0 | −15 | good | −5 | −15 | good | −5 | −20 | good |
| 12 | 0 | −15 | good | −5 | −15 | good | −10 | −25 | good |
| 13 | 0 | −10 | good | −5 | −10 | good | −10 | −15 | good |
| 14 | 0 | −15 | good | −5 | −10 | good | −5 | −15 | good |
| 15 | 0 | −15 | good | −5 | −15 | good | −10 | −20 | good |
| 16 | 0 | −10 | good | −5 | −15 | good | −5 | −20 | good |
| 17 | 0 | −10 | good | −5 | −10 | good | −5 | −15 | good |
| Comparative Example: | | | | | | | | | |
| 4 | −30 | −45 | black dots | −55 | −60 | black dots | −45 | −60 | black dots |
| 5 | −25 | −40 | black dots | −35 | −45 | black dots | −30 | −40 | black dots |
| 6 | −20 | −35 | black dots | −40 | −55 | black dots | −35 | −50 | black dots |

What is claimed is:

1. An electrophotographic photosensitive member comprising an aluminum substrate and a photosensitive layer provided thereon:

said substrate containing an aluminum element, an oxygen element and a titanium element, or an aluminum element, an oxygen element and a zirconium element, at its surface portion on the side of the photosensitive layer, said surface portion formed by chemical conversion without anodizing; and said photosensitive layer containing a chlorogallium phthalocyanine, a hydroxygallium phthalocyanine or an oxytitanium phthalocyanine having an intense peak at each of the Bragg's angles (2θ±0.2°) shown in any one of the following groups a) to e) in Cukα-characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.4°.

2. An electrophotographic photosensitive member according to claim 1, wherein said photosensitive layer contains the chlorogallium phthalocyanine.

3. An electrophotographic photosensitive member according to claim 1, wherein said photosensitive layer contains the hydroxygallium phthalocyanine.

4. An electrophotographic photosensitive member according to claim 1, wherein said photosensitive layer contains the oxytitanium phthalocyanine.

5. An electrophotographic photosensitive member according to claim 1 or 2, wherein said chlorogallium phthalocyanine has an intense peak at each of the Bragg's angles (20θ±0.2°) of 7.4°, 16.6°, 25.5° and 28.2° in CuKα-characteristic X-ray diffraction.

6. An electrophotographic photosensitive member according to claim 1 or 2, wherein said chlorogallium phthalocyanine has an intense peak at each of the Bragg's angles (2θ±0.2°) of 8.7°–9.20, 17.5°, 24.0°, 27.40 and 28.7° in CuKα-characteristic X-ray diffraction.

7. An electrophotographic photosensitive member according to claim 1 or 3, wherein said hydroxygallium phthalocyanine has an intense peak at each of the Bragg's angles (2θ±0.2°) of 6.8°, 15.8° and 26.2° in CuKα-characteristic X-ray diffraction.

8. An electrophotographic photosensitive member according to claim 1 or 3, wherein said hydroxygallium phthalocyanine has an intense peak at each the Bragg's angles (2θ±0.2°) of 7.4°, 9.9°, 25.0° and 28.2° of in CuKα characteristic X-ray diffraction.

9. An electrophotographic photosensitive member according to claim 1 or 3, wherein said hydroxygallium phthalocyanine has an intense peak at each of the Bragg's angles (2θ±0.2°) of 7.5°, 16.3°, 24.9° and 26.4° in CuKα-characteristic X-ray diffraction.

10. An electrophotographic photosensitive member according to claim 1 or 3, wherein said hydroxygallium phthalocyanine has an intense peak at each of the Bragg's angles (2θ±0.2°) of 6.9°, 13.3°, 16.5° and 26.7° in CuKα-characteristic X-ray diffraction.

11. An electrophotographic photosensitive member according to claim 1 or 4, wherein said oxytitanium phthalocyanine has an intense peak at each of the Bragg's angles shown in the group.

12. An electrophotographic photosensitive member according to claim 1 or 4, wherein said oxytitanium phthalocyanine has an intense peak at each of the Bragg's angles shown in the group b).

13. An electrophotographic photosensitive member according to claim 1 or 4, wherein said oxytitanium phthalocyanine has an intense peak at each of the Bragg's angles shown in the group c).

14. An electrophotographic photosensitive member according to claim 1 or 4, wherein said oxytitanium phthalocyanine has an intense peak at each of the Bragg's angles shown in the group d).

15. An electrophotographic photosensitive member according to claim 1 or 4, wherein said oxytitanium phthalocyanine has an intense peak at each of the Bragg's angles shown in the group e).

16. An electrophotographic photosensitive member according to claim 1, wherein the titanium or zirconium at the surface portion of said substrate on the side of the photosensitive layer is in a content of from 4 atom % to 100 atom % based on the content of aluminum.

17. An electrophotographic photosensitive member according to claim 1, wherein the surface portion of said substrate on the side of the photosensitive layer further contains phosphorus.

18. An electrophotographic photosensitive member according to claim 1, wherein the surface portion of said substrate on the side of the photosensitive layer further contains fluorine.

19. An electrophotographic photosensitive member according to claim 1 wherein said surface portion has a layer thickness of 1 μm or smaller.

20. A process cartridge comprising an electrophotographic photosensitive member and at least one means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising an aluminum substrate and a photosensitive layer provided thereon;

said substrate containing an aluminum element, an oxygen element and a titanium element, or an aluminum element, an oxygen element and a zirconium element, at its surface portion on the side of the photosensitive layer, said surface portion formed by chemical conversion without anodizing; and said photosensitive layer containing a chlorogallium phthalocaynine, a hydroxygallium phthalocyanine or an oxytitanium phthalocyanine having an intense peak at each of the Bragg's angles (2θ±0.2°) shown in any one of the following groups a) to e) in Cukα-characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.4°.

21. An electrophotographic apparatus comprising an electrophotographic photosensitive member, a charging means, an exposure means, a developing means and a transfer means;

said electrophotographic photosensitive member comprising an aluminum substrate and a photosensitive layer provided thereon;

said substrate containing an aluminum element, an oxygen element and a titanium element, or an aluminum element, an oxygen element and a zirconium element, at its surface portion on the side of the photosensitive layer, said surface portion formed by chemical conversion without anodizing; and said photosensitive layer containing a chlorogallium phthalocyanine, a hydroxygallium phthalocyanine or an oxytitanium phthalocyanine having an intense peak at each of the Bragg's angles (2θ±0.2°) shown in any one of the following groups a) to e) in Cukα-characteristic X-ray diffraction:

a) 9.0°, 14.2°, 23.9° and 27.1°, b) 9.5°, 9.7°, 15.0°, 24.1° and 27.3°, c) 9.3°, 10.6°, 13.2°, 15.1° and 26.3°, d) 7.6°, 10.2°, 22.5°, 25.3° and 28.6°, and e) 7.1°, 10.4°, 24.8° and 27.4°.

* * * * *

UNITED STATES PATENT AND TRADEMARK OFFICE

CERTIFICATE OF CORRECTION

PATENT NO. : 6,248,490 B1
DATED : June 19, 2001
INVENTOR(S) : Koichi Suzuki et al.

It is certified that error appears in the above-identified patent and that said Letters Patent is hereby corrected as shown below:

Column 2,
Line 17, “thicker” should read -- thicker, --.

Column 4,
Line 17, “of” should be deleted.

Column 9,
Line 22, “5” should be deleted.

Column 12,
Line 53, “I” should read -- 1 --.

Column 15,
Table 1, “Auge” should read -- Auger --.

Column 17,
Table 4, “-200” (second occurrence) should read -- -225 --.

Column 19,
Line 3, “Cukα-” should read -- CuKα- --;
Line 21, “(20θ±0.2º)” should read -- (2θ±0.2º) --;
Line 26, “8.7º – 9.20,” should read -- 8.7º – 9.2, --; and
“27.40” should read -- 27.4º --;
Line 35, “of” (second occurrence) should be deleted; and
Line 50, “group.” should read -- group a). --.

UNITED STATES PATENT AND TRADEMARK OFFICE

CERTIFICATE OF CORRECTION

PATENT NO. : 6,248,490 B1
DATED : June 19, 2001
INVENTOR(S) : Koichi Suzuki et al.

It is certified that error appears in the above-identified patent and that said Letters Patent is hereby corrected as shown below:

Column 20,
Line 12, "claim1" should read -- claim1, --;
Line 32, "phthalocaynine" should read -- phthalocyanine --;
Line 34, "Cukα-" should read -- CuKα- --; and
Line 59, "Cukα-" should read -- CuKα- --.

Signed and Sealed this

Sixteenth Day of July, 2002

*Attest:*

*Attesting Officer*

JAMES E. ROGAN
*Director of the United States Patent and Trademark Office*